US006332795B1

(12) United States Patent
Conorich

(10) Patent No.: US 6,332,795 B1
(45) Date of Patent: Dec. 25, 2001

(54) HINGED CONNECTION SYSTEM

(75) Inventor: Theodore A. Conorich, Lake Hiawatha, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/575,969

(22) Filed: May 23, 2000

(51) Int. Cl.[7] ..... H01R 29/00
(52) U.S. Cl. ..... 439/188; 439/341
(58) Field of Search ..... 439/341, 344, 439/350, 357, 376, 676

(56) References Cited

U.S. PATENT DOCUMENTS 5,607,319 * 3/1997 Wakata et al. ..... 439/341
6,093,044 * 7/2000 Arbuckle ..... 439/354

FOREIGN PATENT DOCUMENTS

3634695 * 4/1988 (DE) .

* cited by examiner

*Primary Examiner*—Khiem Nguyen
(74) *Attorney, Agent, or Firm*—Gibbons, Del Deo, Dolan, Griffinger & Vecchione

(57) ABSTRACT

An electrical connection system for making patch cord connections that uses a hinged plug and jack mating system which results in low insertion forces and enhanced side to side stability for the patch cord connectors. This system allows the jack and most of the mated plug to be positioned behind the label and have the cordage exit the jack towards the back plane and into the troughs that are between adjacent rows of connectors, instead of out from the connector field. This keeps the label area clear of visual obstructions like cordage and connectors.

4 Claims, 6 Drawing Sheets

HINGED CONNECTION SYSTEM

RELATED APPLICATIONS

The present patent application is related to U.S. patent application Ser. No. 09/575,968, entitled "SLIDING CABLE FIXTURE", being concurrently filed herewith and having a filing date of May 23, 2000,; U.S. patent application Ser. No. 09/577,274, entitled, "CONTACTS FOR HINGED CONNECTION SYSTEM" being concurrently filed herewith and having a filing date of May 23, 2000,; to U.S. patent application Ser. No. 09/575,902, entitled "CONNECTOR SYSTEM WITH RELEASABLE LATCH", being concurrently filed herewith and having a filing date of May 23, 2000,; to U.S. patent application Ser. No. 09/577,275, entitled "SNAP-IN MODULE SYSTEM", being concurrently filed herewith and having a filing date of May 23, 2000,; to U.S. patent application Ser. No. 09/577,273, entitled, "BOARD MOUNTED JACK MODULE", being concurrently filed herewith and having a filing date of May 23, 2000,; all of which have a common inventor and assignee and being incorporated herein by reference.

FIELD OF THE INVENTION

The present invention relates to electrical connection systems, and more particularly, to modularized electrical connection systems.

BACKGROUND OF THE INVENTION

In the telecommunications industry, connecting systems comprising an array of insulation displacement contacts (IDC) are typically used in telephone company central offices and the office buildings for electrical connection between cables and cross-connect wiring. These electrical connection systems are used throughout the telecommunications industry in order to interconnect corresponding wires in two sets of wires. The predominant connecting systems for building terminal cross-connect systems are currently the modular RJ45 connector system and the 110 connection system or variations of these connection systems. The modular type connector systems use a plug and jack type interface for making connections.

The RJ45 version of a modular connector system is a 4-pair connector system that cannot be broken down to smaller increments without wasting connector positions. A patch cord connection is made to a jack by deflecting a set of cantilevered spring wires in a jack with a mating set of fixed pressure contact surfaces in the plug, as the plug is pushed into the jack with a relatively low force. As the plug completes its insertion into the jack, it automatically latches with an audible click. By gripping the exposed back end of the plug, and depressing a lever, the latch can be released. The spring loaded wire contacts within the jack essentially push the plug out. The RJ45 modular systems have a panel with a flat front face. When a patch cord is installed, the cordage comes straight out from the panel. Cross-connect distribution rings bring the cordage back in along the face of the panel.

The 110 Connector System is designed with insulation displacement connections for both the cable connections and the cross-connect or patching connections. Therefore, a patching connection can be made by terminating cross-connect wires in the contacts IDC slots, or by inserting patch cord blades into those contact slots.

This Connector System forms a connector field that is front accessible, and is designed for wall mounting. Despite this design, the 110 system can be frame mounted, with the cables fed from the front in a manner similar to wall mounting. The cables can also be fed from the back of the frame. The front access is achieved by having a cross-connect field superimposed on a cable termination field; that is, superimposed on the cable routing. Cables are routed behind the wiring blocks, either in pre-mounted channels or between the rows of wiring block support legs. Cable ends are brought through their appropriate openings in the wiring block to the cable termination surface, and the exposed cable sheath is removed. The cable conductors are fanned out as twisted pairs to their appropriate termination ports in the index strips on the front face of a wiring block. Connecting blocks, which include contacts having insulation displacement portions on two opposite ends, are brought down and snapped onto the index strip to form electrical connections between the contacts and conductors. The front surface formed by the connecting blocks is the cross-connect field. A designation strip is placed between alternate rows and is used to label the conductor terminations on the rows on either side of it.

When a cross-connect field is intended for use with patch cords, 100 pair wiring blocks typically alternate with horizontal troughs, with patch cords from the upper 2 rows going into an upper trough, and patch cords from the lower 2 rows going into a lower trough. When a high percentage of patch cord positions are populated, the patch cord connectors present an unruly appearance and the labeling becomes very difficult to read, making cord location a time consuming process.

Patch cords in the 110 connector system have contact blades that make connection by inserting into the top IDC slots of the contact elements. The IDC are designed to remove insulation as it makes contact, and to achieve a high enough contact force to make a stable long term connection to unplated wire. Repeated insertions, of the patch cord blades, past this entrance geometry, with its high contact force, reduces the life of the patch cord blades protective plating. This contact force (about 2 pounds) holds the patch cord blade by friction and prevents it from sliding out by about a third of a pound per contact. The contact slots are tapered so any vibration or wiggling of the patch cord would cause the blades to slowly walk out of the slots, unless something else held them in place.

Connecting blocks may have hemispherical buttons that match mating holes in the patch cords. By putting on a mated patch cord, the side walls on the plug end flex as they slide over the connecting blocks' buttons, a snap-on/snap-off type of latch is enabled, and the plug end is disconnected. The force to overcome this latch and remove a 4-pair patch cord, with a straight pull, can be as high as 25 pounds. Removal can be effected by a side to side rocking of the patch cord. Because patch cord plugs are in close proximity to each other, removal of one patch cord can easily result in the dislodging of a neighboring patch cord. Therefore, technicians must be very deliberate and careful during cord tracing to avoid inadvertently dislodging a patch cord. Furthermore, the high friction on the connecting blocks' buttons can cause extensive wear of the surfaces so that the retention capability of the connecting blocks degrades after multiple insertions and removals.

SUMMARY

A device according to the principles of the invention enables simple and efficient patch cord connection. An exemplary system provides a plug having a rotatable end and a jack having a corresponding rotatable end. By engaging the rotatable plug end with the corresponding rotatable jack end, a fulcrum is established, enabling the plug to be rotated around the fulcrum point to achieve a connection. The hinging mechanism enables simple and reliable connections.

In an exemplary embodiment, the jack includes a front surface that faces outwards. The front surface serves as a label surface. All cord connections occur behind this label surface. Advantageously, when a plug and a jack are connected, all cordage is routed behind the label surface, providing an unobstructed view of the label surface and permitting fast and accurate identification of all jack terminations.

BRIEF DESCRIPTION OF THE FIGURES

For a better understanding of the present invention, reference may be had to the following description of exemplary embodiments thereof, considered in conjunction with the accompanying drawings, in which:

FIG. 5(*b*) is a partial, cross-sectional top view of a jack and a four pair patch cord plug in accordance with the present invention.

DETAILED DESCRIPTION

Figure 1A:
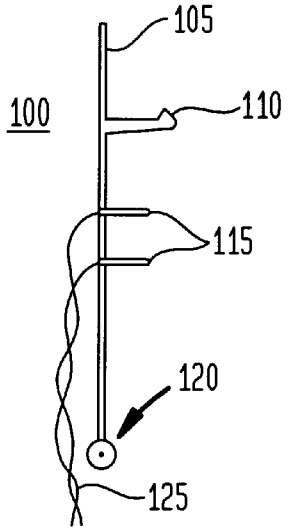
FIGS. 1(*a*)–1(*e*) are schematic diagrams of a plug and a jack in accordance with the present invention.
Figure 1B:
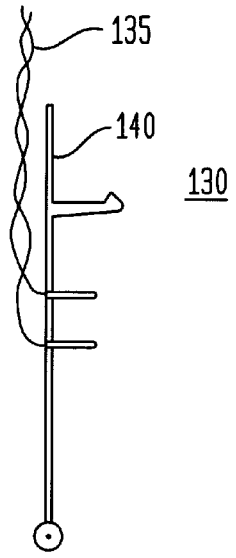
Figure 1C:
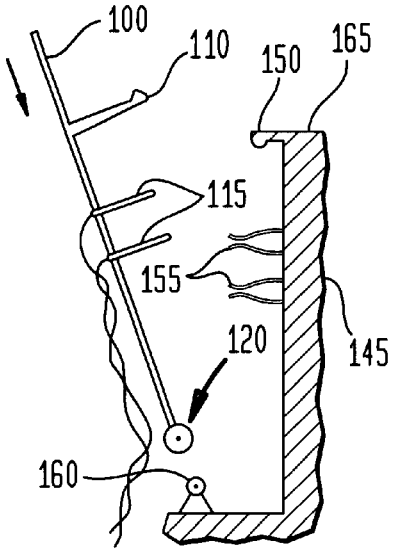
Figure 1D:
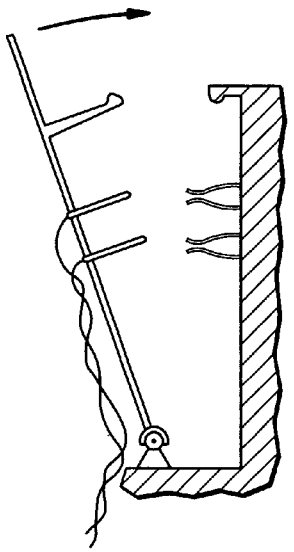
Figure 1E:
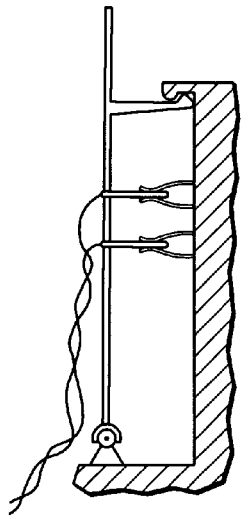

This detailed description initially discusses the cross-connect system according to the principles of the invention. Exemplary embodiments of the cross connect system are then described.

The Cross-Connect System

A cross-connect system according to the invention implements one end of a plug hooking onto a corresponding end of a jack to form a fulcrum. The plug then functions as a lever by rotating about that fulcrum until it mates with the jack.

A plug 100 is illustrated in FIG. 1(*a*). The plug 100 includes a handle 105 on one end. When the plug 100 functions as a lever, the handle 105 serves as one end of that lever. The other end of the lever is the plug fulcrum section 120. The plug 100 further includes a latch 110 that it is located proximate to the handle 105. The latch extends somewhat perpendicularly from the plug 100. A pair of contacts 115 are located between the latch 110 and the plug fulcrum section 120. Cordage 125 is electrically connected to the contacts 115. Although one pair of contacts 115 is shown in the plug 100, it is understood that any plurality of contacts can be included within the plug 100.

In one embodiment of the invention, cordage 125 exits plug 100 at plug fulcrum section 120. As such, cordage 125 is automatically directed toward a back plane (not shown) through a trough 270 in FIGS. 2 and 3(*a*)–(*c*). This keeps the immediate area clear of cordage 125, thereby providing a neat appearance and making it easier for the craftsperson to locate specific jack positions. Also, because the cordage 125 is not directed straight out, the latch engagement is unaffected when cordage 125 is manipulated, as for cord tracing, for example. Latching in this configuration can be implemented using a snap action latch mechanism.

Referring now to FIG. 1(*b*), a plug 130 can also have cordage 135 exit at a handle 140. Since cordage 135 directs away from the back plane in this instance, care must be taken to keep cordage 135 from interfering with patch cord installation or removal. A wider trough may be required and a positive latch with a release mechanism may be required. The remaining illustrations and description employ a snap action latch; however, a positive latch with a release mechanism could also be used.

Referring now to FIGS. 1(*c*)–1(*e*), mating of plug 100 to a jack 145 is illustrated. As shown, jack 145 includes a corresponding latch 150, corresponding contacts 155 and a jack fulcrum section 160. Referring specifically to FIG. 1(*c*), plug fulcrum section 120 engages jack fulcrum section 160. The angle of engagement is sufficiently offset to prevent engagement of latch 110 with corresponding latch 150 and contacts 115 with corresponding contacts 155. Engagement of the latches and contacts is prevented until the fulcrum sections 120 and 160 are fully engaged and the plug rotated towards the jack. In one embodiment, this offset angle or rotation angle is approximately 20°. Referring now to FIGS. 1(*d*) and 1(*e*), handle 105 is used as a lever to rotate plug 100 towards jack 145 until corresponding latch and contact connection is achieved.

Figure 2:
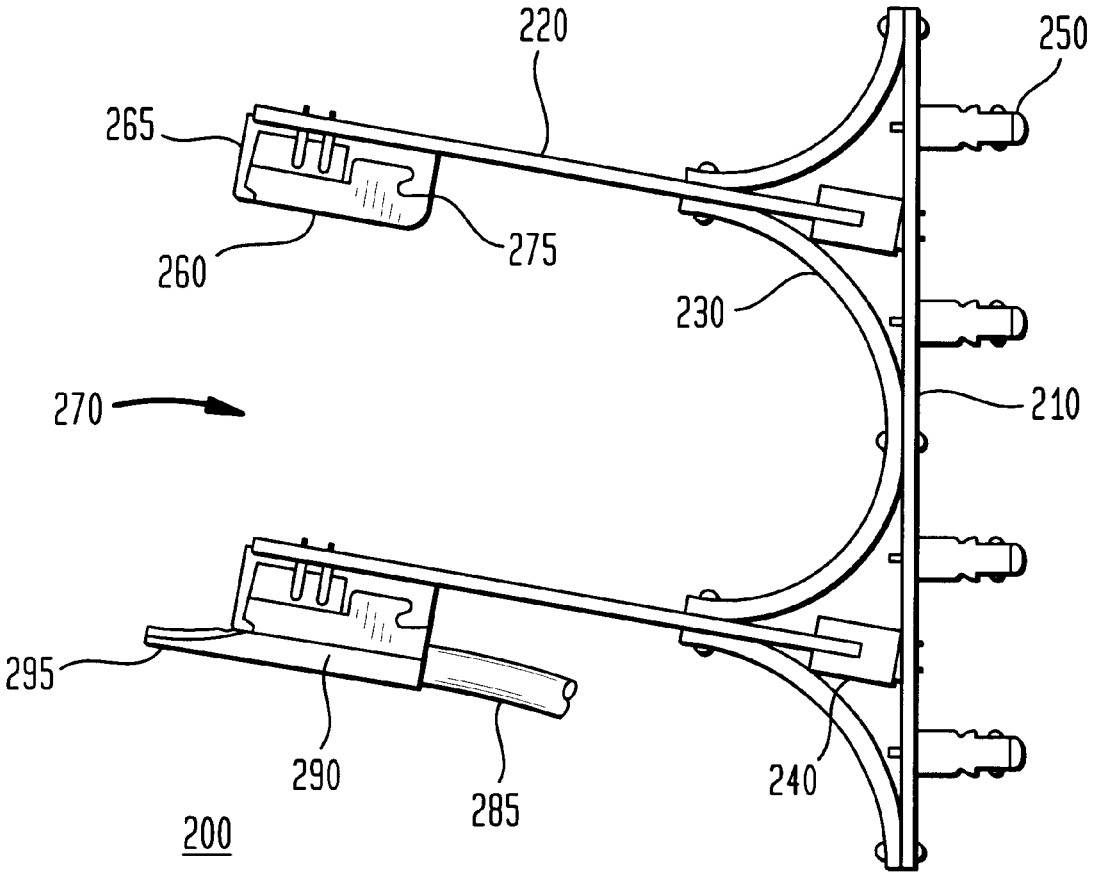
FIG. 2 is a side cross sectional view of a jack mounted on a printed wiring board support structure in accordance with the present invention.

As illustrated in FIG. 1(*c*), corresponding latch 150 further includes a label surface 165. One of the advantages of the cross connect system is that label surface 165 is positioned frontward as shown below and the resulting connection is implemented behind or below label surface 165. This implementation maximizes the area in the cross connect field that can be devoted to either the label or trough space. This advantage is shown in more detail with respect to FIGS. 2 and 3(*a*)–3(*c*). Referring to FIG. 2, a cross sectional view of a printed wiring board utilizing the cross connect system according to the principles of the invention is shown. Cross connect system 200 has a backplane printed wiring board 210 and at least one printed wiring board 220 connected to board 210 using support structures 230 and edge card connectors 240. Connection blocks 250 are attached to board 210 to permit connections with conductors of cables that go to, for example, equipment or wall jacks (not shown). Specifically, a jack 260 is connected to board 220. Jack 260 has a label surface 265 that faces away from board 210.

Figure 3A:
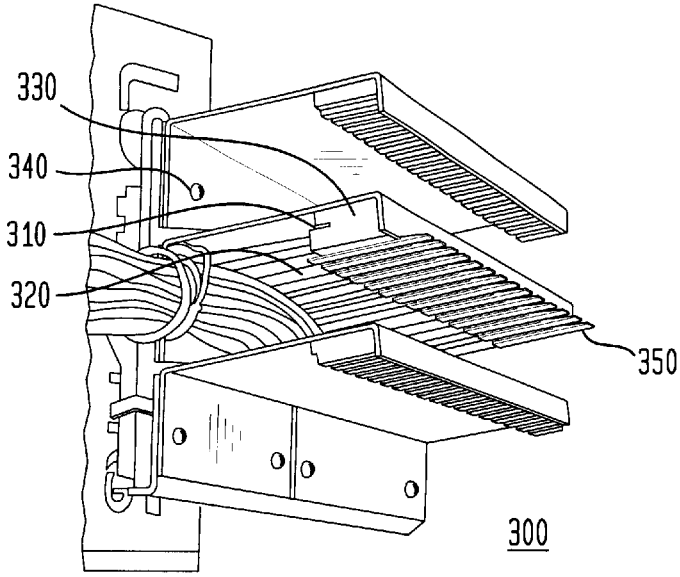
FIGS. 3(*a*)–3(*c*) show multiple perspective views of the embodiment illustrated in FIG. 2.
Figure 3B:
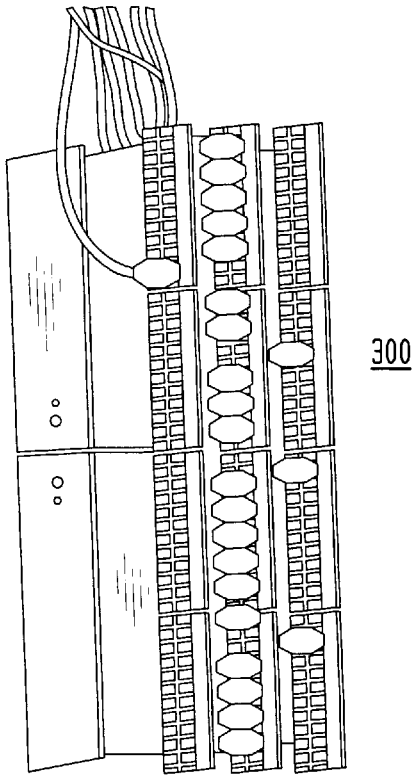
Figure 3C:
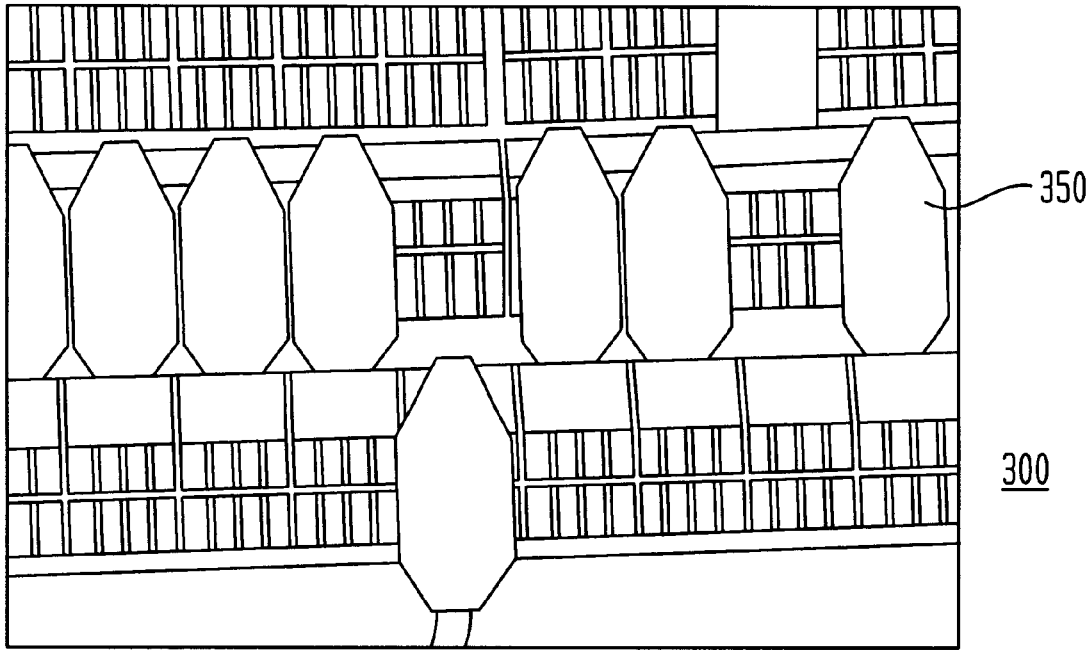

As previously shown in FIG. 1(*e*), the connection between a plug 290 and a jack 260 is made behind label surface 265. If cross connection system 200 further utilizes a scheme where cordage 285 exits at a fulcrum end 275 towards board 210 and into a trough 270, then the only visible object beyond label surface 265 is the relatively small handle 295 of the plug 290. This is shown in FIGS. 3(*a*)–3(*c*). Specifically, FIG. 3(*a*) shows a perspective view of a cross connect system 300 with a mated plug and jack 310. Cordage 320 exits away from label surface 330 and into a trough area 340. FIG. 3(*b*) shows a bottom up view of FIG. 3(*a*) and FIG. 3(*c*) shows a close up view of mated plug and jack 310. FIGS. 3(*a*) and 3(*c*) show that label surface 330 is unobstructed except for the minor presence of handle 350 of mated plug and jack 310. An easy to read label surface is highly valued during cord tracing and other such activities.

Figure 4A:
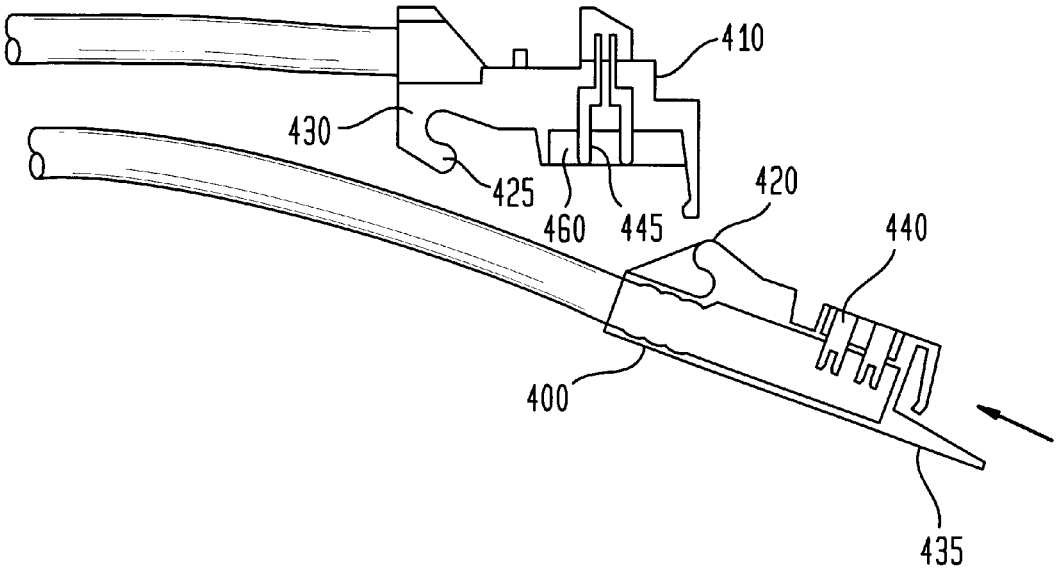
FIGS. 4(*a*) and 4(*b*) are side cross sectional views of a plug and jack in accordance with the present invention.
Figure 4B:
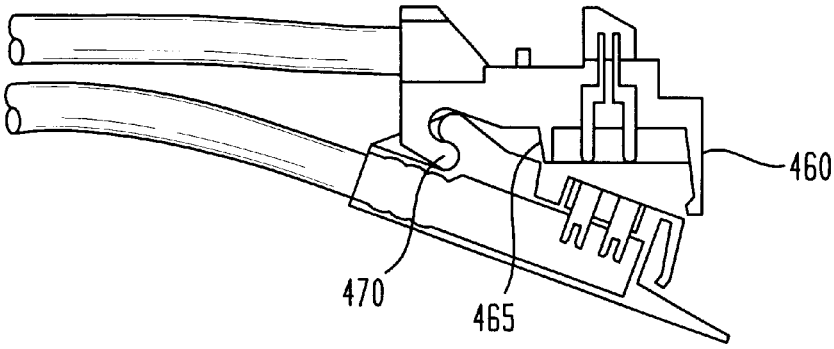
Figure 4C:
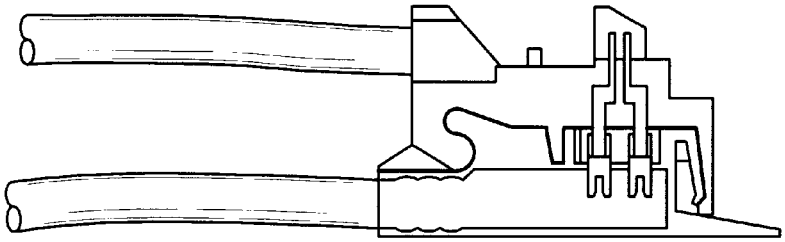

An exemplary embodiment of the present invention can be seen in FIGS. 4(*a*) and 4(*b*). A plug 400 includes a plug fulcrum section 405. A plug bearing hook 420 is seen at the end of the plug fulcrum section 405. A jack 410 includes a hinge bearing hook 430, that forms a hinge bearing surface 425. The jack 410 further includes a pair of guide surfaces 460 that are parallel to each other. The guide surfaces 460 are sufficiently separated in distance in order to accommodate the width of the plug 400. The guide surfaces 460 extend beyond the hinge bearing hook 430. As shown in FIG. 4(*b*), this permits the guide surfaces 460 to protect the contacts in both the plug 400 and jack 410 when they are not engaged with each other since the tips of the contacts are below the outer edges of the guide surfaces 460.

Operationally, the plug 400 is mated with the jack 410 by first taking the plug bearing hook 420 and hooking it onto the hinge bearing surface 425. Because of the extent of the guide surfaces 460, the plug 400 slides easily into the jack 410, thereby facilitating easy coupling of the plug bearing hook 420 and the hinge bearing hook 430. Once the hooks are coupled, the plug 400 is rotated into its seated position by using the handle 435 as a lever to force the plug contacts 440 to mate with the jacks contacts 445. The parallel guide surfaces 460 control the rotation path so that the contacts 440 and 445, respectively, mate in a precise manner. More specifically, plug 400 engages the guide surfaces 460 before the plug 400 fully engages the hinge bearing hook 430. The bearing surfaces 465 and 470 insure that the jack 410 remains fully seated onto the hinge bearing hook 430, as plug 400 completes its rotation. The guide surfaces also provide support, holding the plug 400 in place. The guide surfaces 460 serve as a means of protecting the integrity of the coupling, making accidental de-coupling very difficult. Therefore manipulating the patch cord's cordage has very little effect on the security of the patch cord's connection. The only practical way to disengage a patch cord is by pushing on the handle 435.

Design for Single or Multiple Connections

Figure 5A:
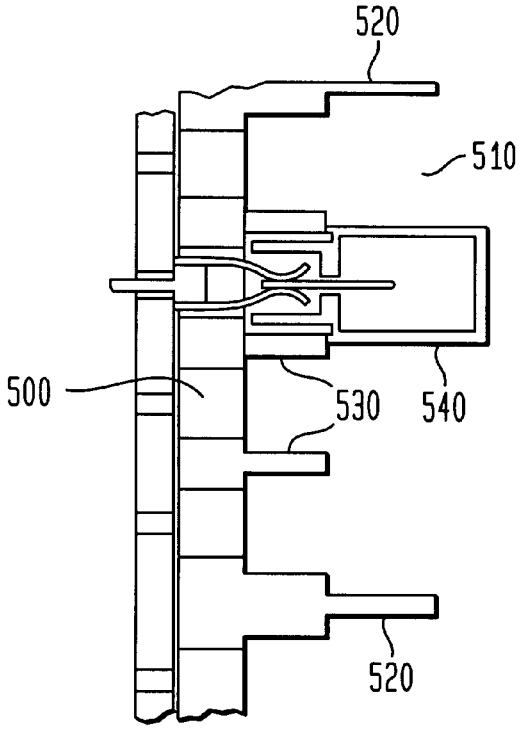
FIG. 5(*a*) is a partial, cross-sectional top view of a mated jack and a one pair patch cord plug in accordance with the present invention.
Figure 5B:
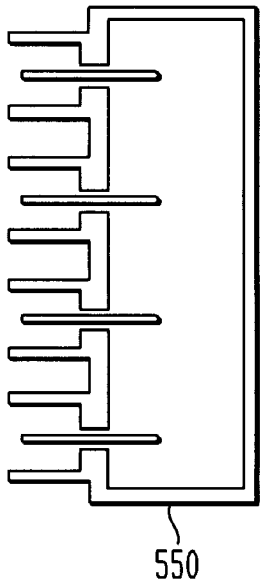

As illustrated in FIGS. 5(*a*) and 5(*b*), the jacks of the present invention permits connections with plugs of different sizes, varying from 1-pair to 4-pair. Referring to FIG. 5(*a*), a jack 500 has at least one 4-pair connection site 510. Jack 500 includes a partitioning wall 520 after every 4-pair connection sites 510. Partitioning walls 520 prevent plugs from crossing over and making connections to contacts in 2 jacks simultaneously. Each 4-pair connection site 510 further includes the previously described guide walls 530. Each site 510 can accommodate a single plug 540, a 4-pair plug 550 as shown in FIG. 5(*b*) or any pair size in between.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that come within the scope of the appended claim is reserved.

What is claimed:

1. A connector system for telecommunications electrical connections, said system comprising:

a base structure, a support structure having a rear portion and a front portion, said rear portion of said support structure being attached to said base structure, a jack affixed to said front portion of said support structure, said jack having a front end positioned near said front portion of said support structure and a rear end extending toward said rear portion of said support structure, said jack having a label surface facing outwardly from said front end, said jack having a latch receptacle located near said front end and a pivot connection located near said rear end, said support structure forming a wiring trough, said wiring trough being formed adjacent to the rear portion of said support structure and in front of said base structure; and a plug having a pivot end, a latch end and electrical contacts located between said pivot end and said latch end, said plug adapted to be affixed to said jack by means of first establishing a fulcrum point common to said jack and said plug by engaging said pivot end with said pivot connection of said jack, and said plug being rotated about said fulcrum point until an electrical connection is made with said jack and the latch end of said plug mechanically latches with said latch receptacle of said jack, said plug having wiring extending from said pivot end of said plug toward said rear portion of said support structure to pass into said wiring trough wherein said label area is visible without interference from said wiring.

2. A connector system as defined in claim 1 wherein said plug comprises 1, 2, 3 or 4 pair of connectors and can mate with said jack individually or in a combination thereof to make up a four pair circuitry.

3. A connector system as defined in claim 1 wherein said front portion of said support structure comprises a plurality of receptacles in a plurality of rows.

4. A connector system for telecommunications electrical connections, said system comprising:

a base structure, a support structure having a rear portion and a front portion, said rear portion of said support structure being attached to said base structure, a jack affixed to said front portion of said support structure, said jack having a front end positioned near said front portion of said support structure and a rear end extending toward said rear portion of said support structure, said jack having a label surface facing outwardly from said front end, said jack having a latch receptacle located near said front end and a pivot connection located near said rear end, said pivot connection adapted to form a common pivot point with a plug to enable a plug to be rotated about said pivot point to be retained by said latch receptacle forming an electrical connection therebetween, said support structure forming a wiring trough, said wiring trough being formed adjacent to the rear portion of said support structure and in front of said base structure to enable wires from a plug to pass into said wiring trough, said label area is visible without interference from said wiring.

* * * * *